US011821254B2

(12) United States Patent
Eggert et al.

(10) Patent No.: US 11,821,254 B2
(45) Date of Patent: Nov. 21, 2023

(54) DOOR PRESENTING DEVICE FOR A MOTOR VEHICLE DOOR ELEMENT

(71) Applicant: Kiekert AG, Heiligenhaus (DE)

(72) Inventors: Marco Eggert, Düsseldorf (DE); Uwe Reddmann, Essen (DE); Christian Sturm, Krefeld (DE)

(73) Assignee: Kiekert AG, Heiligenhaus (DE)

( * ) Notice: Subject to any disclaimer, the term of this patent is extended or adjusted under 35 U.S.C. 154(b) by 148 days.

(21) Appl. No.: 17/438,971

(22) PCT Filed: Mar. 9, 2020

(86) PCT No.: PCT/DE2020/100162
§ 371 (c)(1),
(2) Date: Sep. 14, 2021

(87) PCT Pub. No.: WO2020/187360
PCT Pub. Date: Sep. 24, 2020

(65) Prior Publication Data

US 2022/0127893 A1 Apr. 28, 2022

(30) Foreign Application Priority Data

Mar. 21, 2019 (DE) ..... 10 2019 107 250.6
Apr. 5, 2019 (DE) ..... 10 2019 108 947.6
Jun. 6, 2019 (DE) ..... 10 2019 115 304.2

(51) Int. Cl.
*E05F 5/00* (2017.01)
*E05F 5/06* (2006.01)
*E05F 15/619* (2015.01)

(52) U.S. Cl.
CPC ..... *E05F 5/06* (2013.01); *E05F 15/619* (2015.01); *E05Y 2201/224* (2013.01);
(Continued)

(58) Field of Classification Search
CPC .. E05F 5/06; E05F 5/00; E05F 15/619; E05Y 2201/224; E05Y 2201/232;
(Continued)

(56) References Cited

U.S. PATENT DOCUMENTS 3,202,414 A 8/1965 Simmons et al.
5,058,258 A 10/1991 Harvey
(Continued)

FOREIGN PATENT DOCUMENTS

DE 29812121 U1 11/1999
DE 102011015669 A1 10/2012
(Continued)

OTHER PUBLICATIONS

International Search Report dated Jun. 19, 2020, for International Patent Application No. PCT/DE2020/100162.

*Primary Examiner* — Chi Q Nguyen
(74) *Attorney, Agent, or Firm* — Renner, Otto, Boisselle & Sklar, LLP

(57) ABSTRACT

A door presenting device for a motor vehicle door element having an electric drive unit and an actuating means, wherein the actuating means can be adjusted by means of the drive unit and a gear mechanism arranged between the actuating means and the drive unit, with the result that a movement of the door element can be enabled, and further having a locking means. The door element can be maintained in position by means of the locking means and the locking means can be electrically actuated, namely indirectly, preferably manually, actuated.

18 Claims, 1 Drawing Sheet

(52) U.S. Cl.
CPC ... *E05Y 2201/232* (2013.01); *E05Y 2201/244* (2013.01); *E05Y 2201/246* (2013.01); *E05Y 2201/266* (2013.01); *E05Y 2201/434* (2013.01); *E05Y 2201/626* (2013.01); *E05Y 2201/702* (2013.01); *E05Y 2201/704* (2013.01); *E05Y 2201/716* (2013.01); *E05Y 2201/722* (2013.01); *E05Y 2400/44* (2013.01); *E05Y 2800/11* (2013.01); *E05Y 2800/424* (2013.01); *E05Y 2900/531* (2013.01)

(58) Field of Classification Search
CPC ..... E05Y 2201/246; E05Y 2201/266; E05Y 2201/434; E05Y 2201/626; E05Y 2201/702; E05Y 2201/704; E05Y 2201/716; E05Y 2201/722; E05Y 2400/44; E05Y 2800/11; E05Y 2800/424; E05Y 2900/531
See application file for complete search history.

(56) References Cited

U.S. PATENT DOCUMENTS

| | | | | |
|---|---|---|---|---|
| 9,995,066 | B1 | 6/2018 | Ottolini et al. | |
| 11,040,593 | B1 * | 6/2021 | Chen | E05F 15/71 |
| 2018/0038146 | A1 | 2/2018 | Linden et al. | |
| 2018/0051502 | A1 * | 2/2018 | Roos | E05B 81/06 |
| 2018/0179788 | A1 * | 6/2018 | Oxley | E05B 81/13 |
| 2019/0024421 | A1 * | 1/2019 | Cumbo | G07C 9/00174 |
| 2019/0040657 | A1 * | 2/2019 | Goldsworthy | E05B 77/04 |
| 2019/0153768 | A1 * | 5/2019 | Termine | E05F 15/622 |
| 2019/0292818 | A1 * | 9/2019 | Cumbo | E05C 17/003 |
| 2020/0131836 | A1 * | 4/2020 | Ottino | E05F 1/105 |
| 2020/0270928 | A1 * | 8/2020 | Cumbo | E05F 15/611 |
| 2020/0270930 | A1 | 8/2020 | Reddmann | |
| 2021/0301561 | A1 * | 9/2021 | Cumbo | E05B 83/36 |
| 2022/0034145 | A1 * | 2/2022 | Reddmann | E05C 17/003 |
| 2022/0268080 | A1 * | 8/2022 | Sturm | E05F 15/60 |

FOREIGN PATENT DOCUMENTS

| | | | |
|---|---|---|---|
| DE | 102016105760 | A1 | 10/2017 |
| DE | 102017214174 | A1 | 2/2018 |
| DE | 102017223104 | A1 | 6/2018 |
| DE | 102017124282 | A1 | 4/2019 |
| EP | 2193740 | A1 | 6/2010 |

* cited by examiner

DOOR PRESENTING DEVICE FOR A MOTOR VEHICLE DOOR ELEMENT

This application is a national phase of International Application No. PCT/DE2020/100162 filed Mar. 9, 2020, which claims priority to German Patent Application Nos. 10 2019 107 250.6 filed Mar. 21, 2019, 10 2019 108 947.6 filed Apr. 5, 2019, and 10 2019 115 304.2 filed Jun. 6, 2019.

FIELD OF INVENTION

The invention relates to a door presenting device for a motor vehicle door element having an electric drive unit and an actuating means, wherein the actuating means can be adjusted by means of the drive unit and a gear mechanism arranged between the actuating means and the drive unit, with the result that a movement of the door element can be enabled, and further having a locking means, wherein the door element can be maintained in position by means of the locking means and the locking means can be electrically actuated.

BACKGROUND OF INVENTION

Today's motor vehicles are being increasingly equipped with comfort functions. For example, in order to make it easier to get into a motor vehicle and to be able to influence the aesthetic as well as aerodynamic design, motor vehicles are equipped without an external door handle, for example. It is also conceivable, however, that an exterior door handle is provided, but that this handle merely transmits a switching signal to the motor vehicle door lock to open the door. In order to facilitate and automate entry and to enable entry into vehicles without external door handles, for example, so-called door presenting devices or door openers are used, some of which are also referred to as door checks.

An opener for motor vehicle doors or flaps is known from DE 10 2011 015 669 A1, with which a door, flap or hood can be transferred from a closed position to an open position. If the door opening device relates to a motor vehicle side door, for example, the door can be opened by means of an electrical pulse. For this purpose, the locking mechanism of the door lock must first be unlocked, preferably electrically, so that the door can be opened. If, for example, the door seal pressure is not sufficient to move the door from the closed position to an open position, the door can be moved to an open position by means of the check device. An open position is defined here in such a way that the operator of the motor vehicle is able to grasp the door so that he can open the door completely. The opening device is an electric drive that acts mechanically on the motor vehicle door via a driving pawl and an inner and outer lever in the form of a pivoting movement of the levers.

DE 10 2016 105 760 A1 discloses a door presenting device for a motor vehicle door with a base plate, further with a drive element mounted on the base plate and a drive, wherein a first sensor associated with the drive element is provided, which distinguishes at least between a presenting process and a manual opening process. In this case, the presenting device comprises a drive which can be driven via a sensor and a control unit. A flexible connecting means then enables a pivoting of a transmission lever, which in turn enables an opening movement via a drive lever and a drive slide. To enable movement of the door, the drive slide moves linearly and, for example, out of an opening in a vehicle body, so that a released and unlocked door is at least partially openable. The end position of the drive slide can be detected by means of a second stationary sensor, so that the drive can in turn be switched off.

From the applicant's unpublished patent application (DE 10 2017 124 282.1) a door presenting device for a motor vehicle door element has become known, comprising an electric drive and actuating means, wherein the actuating means is adjustable by means of the drive and a gear arranged between the actuating means and the drive. By means of the presenting device a movement of the door is possible, whereby a sliding element is arranged at the actuating means, which interacts with a switching means, so that the door movement is detectable. The actuating means is essentially formed by a driven toothed rack with integrated sliding element, switching means and electrical supply line. By means of the switching means between the sliding element and the vehicle body, it is possible to control the movement of the driven toothed rack.

The generic prior art is formed by the applicant's patent application (DE 10 2018 132 665.3), which is also unpublished. The publication discloses a presenting device for a motor vehicle door element comprising an electric drive and an actuating means, wherein the actuating means is adjustable by means of the drive and a gear arranged between the actuating means and the drive, so that movement of the door element is possible, and a sensor for detecting the door movement, wherein the door element can be maintained in position by means of the actuating means. By means of a locking means, the presenting device is capable of opening the door element and holding it in the open position. Furthermore, it is possible to move the door element into a closed position also by means of the presenting device.

The devices known from the prior art have in principle proven themselves, but reach their limits when, for example, there is a power failure and the operator of the motor vehicle must be able to open the door manually or when unintentional opening is to be prevented. This is where the invention comes in.

SUMMARY OF INVENTION

It is the task of the invention to provide an improved presenting device for a motor vehicle door element. Furthermore, it is the task of the invention to provide a presenting device which enables an emergency actuation of the presenting device and is capable of preventing an unintentional opening. Furthermore, it is the task of the invention to provide a structurally simple and cost-effective solution.

The task is solved by the features of the independent claim 1. Advantageous embodiments of the invention are indicated in the subclaims. It is pointed out that the embodiments described below are not limiting, rather any variations of the features described in the description and the subclaims are possible.

According to claim 1, the task of the invention is solved by providing a presenting device for a motor vehicle door element, comprising an electric drive and an actuating means, wherein the actuating means is adjustable by means of the drive and a gear arranged between the actuating means and the drive, so that a movement of the door element is possible, and a locking means, wherein the door element is maintained in position by means of the locking means and the locking means is electrically actuatable, and wherein the locking means is indirectly actuatable, in particular manually actuatable. The design of the presenting device according to the invention now makes it possible to hold the door element securely, on the one hand, and to be able to unlock it manually, on the other hand, in the event of a power failure, for example. Consequently, the door element can be moved and positioned safely in an advantageous manner, whereby the locking means can be actuated indirectly and preferably manually.

If, for example, the motor vehicle door element is operated by an operator, for example by an external door handle generating a signal to unlock a lock, for example an electric lock, and the presenting device receives a signal to present the door, the presenting device moves the motor vehicle door element into an open position in which the operator can grasp the open door and open it completely. If, in this position of the motor vehicle door, sufficient current is not available to electrically release the holding means or the locking means, it is possible, according to the invention, to manually operate the presenting device and disengage the locking means so that the door element can be moved independently of the presenting device. The presenting device opens the door element only to such an extent that the door element can be grasped by the operator, but at the same time there is no unintentional opening beyond the open position by means of the presenting device. Thus, there is a maximum of safety so that neither persons are endangered nor the door element itself is opened into a danger zone. Indirectly, however, this also means that a locking lever can be actuated by means of an auxiliary means, such as an actuating shaft and electrically.

If, alternatively, and for example, the motor vehicle door element is actuated by an operator, for example by an interior door handle generating a signal to unlock a lock, for example an electric lock, and the presenting device receives a signal to present the door, movement of the door element can be prevented by means of the presenting device. Thus, for example, a child safety device can be represented by means of the presenting device for the motor vehicle, whereby no additional components are required in the motor vehicle door element.

The presenting device is used with a motor vehicle door element. However, the motor vehicle door element can also be, for example, a flap, hood or cover, for example for a convertible roof. Holding the component movably arranged on the motor vehicle may also be necessary, for example, due to environmental influences such as wind, in order to prevent unintentional opening. The presenting device can thus be used wherever a component movably arranged on the motor vehicle is to be positioned for further opening. In an advantageous manner, the presenting device interacts with an electrically operable closing system, so that a high degree of design freedom is possible in the design of the door element. For example, the door element can dispense with a door handle, resulting in an almost arbitrary design on an outer shape of the door element.

Usually, the presenting device is arranged in the area of the door element in such a way that the door element can be positioned by actuating the presenting device. The presenting device generates a relative movement between the body and the door element, the presenting device preferably being arranged in the door element itself. An arrangement in the body for moving the door element is of course also conceivable. It is also conceivable that the presenting device is integrated in the motor vehicle lock, for example of a side door. This offers the advantage that an electrical voltage is available for the drive and/or that further functions in the motor vehicle lock can be actuated by the drive.

The electric drive preferably consists of a DC motor which interacts with an output shaft and, for example, with the actuating means via a worm gear. Single-, two- or multi-stage gears are conceivable, whereby the selection of the gear can influence the force available at the actuating means. If, for example, the presenting device is arranged in the door element in such a way that the presenting device interacts, for example, with an A-pillar of the motor vehicle and a front door, higher forces are required to set up the door element than if the presenting device is again arranged in a front door of a motor vehicle and acts on a B-pillar in the motor vehicle. In the case of a door being set up and the presenting device being arranged in the area of the motor vehicle lock, lower forces are required, so that higher transmission ratios can be used.

The electric drive enables the movement of the actuating means in this case. By means of the electric motor, it is possible to move the actuating means in such a way that the door can be opened by the driven actuating means. In doing so, the actuating means moves relative to the vehicle body and exerts a compressive force on the vehicle door element so that the released and unlocked door can be moved.

The presenting device preferably interacts with a motor vehicle lock which has a rotary latch and at least one locking pawl, the locking system comprising a rotary latch and at least one locking pawl preferably being electrically unlockable. In the case of electrically unlockable locking systems in particular, the operator of the motor vehicle requires only an electrical pulse to move the locking system into an unlocked, i.e. open position. The locking system is then open so that the door or flap can be moved. The electrical opening pulse for the vehicle lock can be generated by means of a sensor, a key or, for example, a sensitive means such as a touch sensor or an external door handle with an integrated sensor.

Once the vehicle door element is unlocked, the door element can be freely pivoted in the hinges. If necessary, the door still has a door catch strap that can hold the door in several opening positions. Once unlocked, the door can then be moved by means of the presentation device, whereby the movement of the vehicle door element can be detected by sensors. The complete presentation process is detected. The movement is detected continuously, so that the door movement can be detected at any time during the movement of the vehicle door element by means of the presentation device. A door moved once manually beyond the movement of the presentation device disconnects the sensory detection in the presentation device, so that the electric drive can be de-energized or the polarity of the electric drive can be reversed, so that the presentation device can be moved back to its initial position. The detection of a manual movement of the vehicle door element is explained in detail below.

In one embodiment of the invention, the locking means comprises a locking lever, wherein the locking lever is manually pivotable. The use of a lever in the locking means offers the advantage that a leverage and thus a transmission is available to actuate a locking and unlocking of the locking means. The presenting device can be used to transmit large forces when, for example, heavy or sluggish doors need to be operated. For example, sluggishness may be due to a door seal that is iced over, for example. There may also be sluggishness of the door itself, for example, due to signs of aging. In addition, gripping of the door by the operator can also exert an additional force on the presenting device. In all these cases, high forces may be present in the locking means, which must be releasable by the drive of the locking means. Here, the use of a locking lever offers the advantage that a favorable transmission ratio can be set in the lever so that, on the one hand, secure locking, but also secure unlocking of the locking means can be ensured at any time. A pivotable bearing of the locking lever can thus be used in an advantageous manner for locking and unlocking the locking means. For example, the locking lever can engage in a locking contour on the motor vehicle body. The pivoting movement offers an easy way to provide a secure engagement between the locking lever and the locking contour.

If the locking lever is electrically pivotable, in particular pivotable by means of a locking drive, a further embodiment of the invention results. The locking drive as well as the drive for the actuating means are connected to a control, which enables interaction of the actuating means as well as the locking lever. Depending on the control signal, which is sent to the control system by an operator by means of a radio remote control, for example, the locking mechanism can engage and provide an operative connection between the actuating means and a locking contour on the motor vehicle. After locking, the motor vehicle door can then be set up and held in position by means of the electric drive for the actuating means. Depending on the case, a further control signal can then be sent to the locking means and in particular to the locking drive during presenting, after the opening position has been reached or during closing, so that the locking mechanism can be unlocked. The separate electric drive thus makes it possible to initiate unlocking at any time, thus providing maximum flexibility for the operator of the motor vehicle.

A further advantageous embodiment of the invention is when the locking lever can be actuated indirectly, in particular by means of an actuating shaft. Indirect actuation of the locking lever makes it possible to arrange the electric locking drive in a fixed position in the presenting device. The actuating means moves relative to the stationary actuating means drive and also to the stationary locking drive. By means of an actuating shaft, which can be driven indirectly by the electric locking drive, it is thus possible to provide remote actuation of the locking lever. In addition, a transmission ratio can be created by means of the actuating shaft and an engagement kinematics in the locking lever, so that safe locking and unlocking is possible even in extreme situations. Greater forces may have to be applied to the locking mechanism, for example, if an operator of the motor vehicle grips the already partially opened door and the operator wants to open the door fully. At this moment, the control system receives a signal, for example via the presenting device, so that unlocking can be initiated. At the time of unlocking, however, the force that the operator exerts on the door already acts on the locking mechanism and in particular on the locking lever. In order to be able to provide a sufficient force for unlocking by the locking drive in this case as well, a translated force can be introduced into the locking lever by means of the actuating shaft, so that the transmission ratio in the actuating shaft is available for safely unlocking the locking means.

A further embodiment of the invention results when an operating lever is provided and the operating lever is operatively connected to the actuating shaft. An operating lever enables the operator of the motor vehicle to release the presenting device manually. The operating lever can be arranged in a fixed position in the presenting device. If, for example, there is a power failure or power loss, so that sufficient power supply cannot be provided to unlock the presenting device, emergency actuation can be performed by means of the operating lever. Advantageously, the number of components required can be reduced to a minimum by placing the operating lever on the actuating shaft.

In an advantageous manner, the operating lever can be actuated electrically, which results in a further embodiment of the invention. In this case, electrical actuation of the operating lever makes it possible for the operating lever to perform a dual function. On the one hand, the operating lever can be used manually for unlocking in an emergency and, at the same time, the operating lever can serve as a drive means for the locking drive. If the locking drive accesses the operating lever and ultimately the actuating shaft, the number of components can be reduced and at the same time a favorable lever arrangement with a favorable lever torque can be provided for actuating the locking lever. For example, the operating lever can be mounted on the actuating shaft and have a toothing in which a gear wheel, for example arranged on the output shaft of the locking drive, engages. Thus, electrical locking and unlocking as well as manual emergency unlocking can be provided with a minimum number of components.

In another embodiment, the operating lever and the locking drive are operatively connected by means of a gear unit. By coupling the operating lever to the locking drive via a gear unit, a favorable transmission ratio can be set for the drive. In particular, this makes it possible to use a motor with a low power rating, which in turn has a beneficial effect on the costs of the presenting device. In addition, the actuating time for the locking lever can be influenced via the gear unit, so that very short actuating times in the drive for the locking lever can also be realized. A further embodiment of the invention results when the actuating shaft is displaceably received in the actuating means. By a displaceable reception of the adjusting shaft in the adjusting means, a relative movement between the actuating shaft and the actuating means is possible. The actuating shaft is stationary and preferably received and mounted in the operating lever and extends into the actuating means. A further bearing point for the actuating shaft can be arranged in the actuating means itself, whereby the bearing point can be arranged in a fixed position in the actuating means. Thus, during the adjustment of the actuating means by the electric drive, a relative movement takes place between the actuating shaft and the actuating means. At the same time, the actuating shaft remains continuously engaged with the locking lever, so that unlocking of the locking means is possible at any time. The adjusting shaft can be accommodated in the operating lever on one side so as to be fixed against rotation and can be mounted in the operating lever. In addition, of course, it is also possible for the actuating shaft to be mounted in the area of the operating lever and to form a bearing point for the operating lever. In an advantageous manner, the operating lever can thus be actuated via the locking drive and the gear unit, resulting in a rotation of the actuating shaft. The actuating shaft itself can engage directly with the locking lever or pivot the locking lever by means of an actuating means. The actuating means can advantageously be designed as a sliding element and engage with the actuating shaft. The rotary movement of the actuating shaft can then displace the sliding element and actuate the locking lever. In an advantageous embodiment, the sliding element is guided in a linearly displaceable manner in the actuating means and, in particular, in the interior of the actuating means. If the locking lever is also arranged in a recess or in an interior of the actuating means, a structurally favorable embodiment of the presenting device can be provided. By arranging the sliding element and the locking lever inside the actuating means, the actuating means can function independently of external weather influences. This enables a longevity of the presenting device and ensures a high functionality of the presenting device and in particular a functionality of the locking means even under extreme weather conditions, such as frost and/or humidity.

If an actuation of an inner door handle can be detected by means of the control unit, wherein a signal of the actuation of the inner door handle can be evaluated for controlling the presenting device, a further advantageous embodiment of the invention results. On the one hand, an opening signal for the door element can be given by means of, for example, a radio remote control, but it is also possible for an occupant of the vehicle to actuate an interior door handle, as a result of which the presenting device receives a signal to move the door element into an opening position. If in this case the interior door handle is provided with a child safety lock and if it is switched on, a child safety lock can be displayed by means of the presenting device. By means of the presenting device, a lock functionality can thus be realized and an opening of the door element can be prevented. For this purpose, the locking lever can be engaged with the locking contour, with the drive of the presenting device acting as a brake in this case. Unintentional opening or unauthorized opening can consequently be prevented.

In a further embodiment of the invention, a movement of the door element can be detected by means of a movement and/or environment sensor, whereby a signal from the movement and/or environment sensor can be evaluated for controlling the presenting device. In an advantageous manner, further sensors in or on the motor vehicle can be integrated into the functionality of the presenting device. The presenting device and the other sensors are electrically connected to each other, for example, via a control system integrated in the motor vehicle or a separate control system assigned to the door element, for example. If a further sensor detects an obstacle, for example, the control system can send a signal to the presenting device and initiate locking of the presenting device, for example. This can prevent the door element from being set up and/or delay it, for example. If, for example, an approaching cyclist is detected by means of an environment sensor, opening or moving of the door element can be prevented by means of the presenting device. On the one hand, opening can be prevented, but it is also possible to stop the door element while it is moving, for example to prevent a possible collision. On the other hand, it is possible to prevent the door element from being released. If, for example, the door element, which is already in the open position, is grasped by the operator for opening and another sensor detects an obstacle, release of the door element can be prevented, with the locking lever remaining in the locked position, for example. By integrating the additional sensors into the presenting device, the safety of the presenting device can be further increased and its functionality can be further enhanced.

It can further be advantageous and represent an embodiment of the invention if at least one further electric drive is provided for moving the door element. The presenting device, which can also be referred to as a door check, moves the door element into a presenting position in which the door element can be gripped by the operator and opened completely. In addition, a door drive, i.e. an electric drive for moving the door element into a fully open position, may be installed in the motor vehicle. In the interaction of the presenting device and the door drive, a fully automatic opening of the door element is possible. In this case, the presenting device can in turn serve as a safety means to prevent the door element from braking or opening if, for example, another sensor detects an obstacle or a child safety lock is inserted. By means of a locking of the presenting device, a means for active intervention in the opening process can be provided, at least with respect to the displacement of the presenting device, and thus a maximum degree of safety can be achieved.

BRIEF DESCRIPTION OF DRAWINGS

In the following, the invention is explained in more detail with reference to the accompanying drawings by means of an exemplary embodiment. However, the principle applies that the exemplary embodiment does not limit the invention, but merely represents an embodiment. The features shown can be implemented individually or in combination with further features of the description as well as the patent claims.

The figures show.

DETAILED DESCRIPTION

Figure 1:
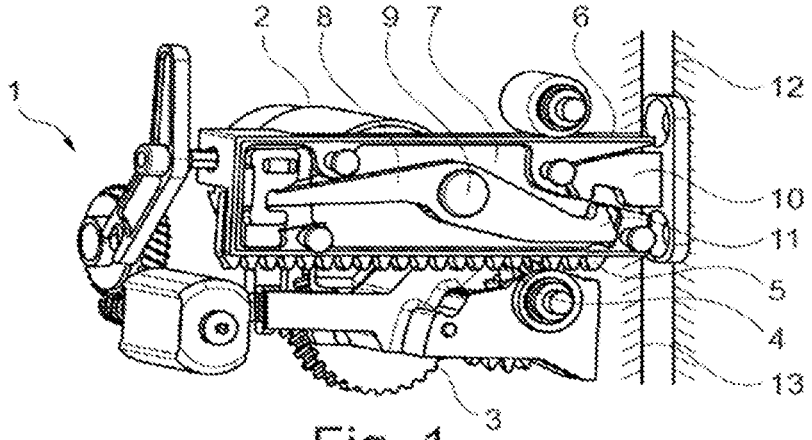
FIG. 1 shows a three-dimensional view of a presenting device in an initial position, that is, of a closed motor vehicle door element and in the unlocked state.

FIG. 1 shows a three-dimensional view of a presenting device 1. The presenting device 1 comprises an electric drive 2, a gear 3 connected downstream of the electric drive 2, the gear 3 being in engagement with a rack 5 by means of a gear wheel 4. The rack 5 in turn forms part of the actuating means 6 and is fixedly connected to the actuating means 6. A locking lever 8 is accommodated in the interior 7 of the actuating means 6 so that it can pivot. The locking lever 8 can be pivoted about an axis 9 and can be brought into positive engagement with a locking contour 10. In doing so, a hook-shaped end 11 engages the locking contour 10. Of course, other forms of a positive and/or non-positive connection between the locking lever 8 and the locking contour 10 are also conceivable according to the invention. In this embodiment, the locking contour 11 is screwed to the body of the motor vehicle as a separate component and is thus firmly connected. The basic structure of the electric drive 2 and the interaction of the electric drive 2 with the transmission 3 and the actuating means 6 are described in the generic prior art according to (DE 10 2018 132 665.3), this part of the description of the prior art being fully declared to be part of the disclosure content of the application.

The actuating means 6 is reproduced in an initial position, wherein the actuating means is reproduced fully retracted into the motor vehicle door element 13. Consequently, the motor vehicle door element 13 is closed and the presenting device is out of operation.

If a signal is now transmitted to the presenting device 1 by an operator of the motor vehicle that the door is to be presented, a gear 15 is actuated by means of a locking drive 14, whereby an operating lever 16 is moved. The operating lever 16 pivots an actuating shaft 17, the actuating shaft 17 moving a sliding element 18 inside 7 of the actuating means 6, causing the locking lever 8 to pivot about the axis 9 in the direction of the arrow P1. The locking lever 8 comes into engagement with the locking contour 10, so that safe guiding and presenting of the motor vehicle door element 13 is possible.

The presenting of the motor vehicle door element 13 is thus also possible in a safe manner if, for example, external influences act on the motor vehicle door element. If, for example, the motor vehicle is on a sloping road and/or stormy wind movements additionally act on the motor vehicle door element, safe guiding of the motor vehicle door element 13 can be ensured at any time by means of the presenting device. The motor vehicle receives a control signal through the operator that the motor vehicle door element 13 is to be opened. On the one hand, the control signal causes an electrical unlocking of a motor vehicle lock, wherein the presenting device 1 preferably cooperates with an electrically unlockable motor vehicle lock, so-called B-locks. The unlocked lock releases a latch so that the locked actuating means can present the door 13. During the presenting process, the actuating means is guided between the gear wheel and a guide means 19.

Figure 2:
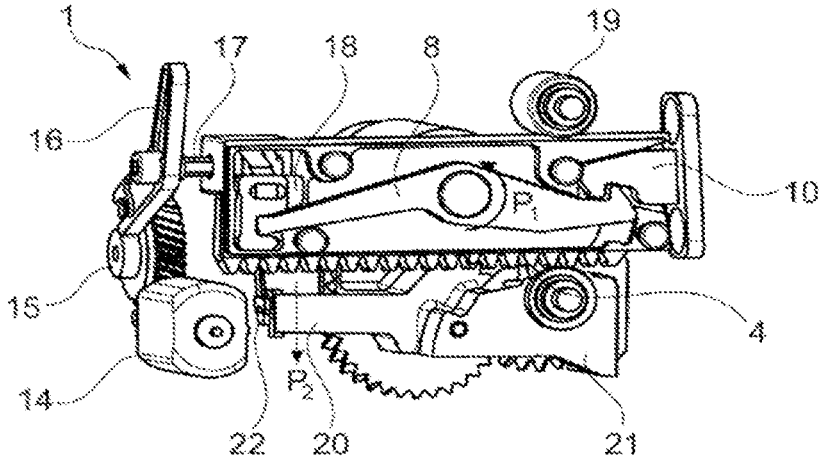
FIG. 2 shows a three-dimensional view of the presenting device according to FIG. 1, with the locking lever reproduced in a locked position, and FIG. 3 in turn shows a three-dimensional view of the presenting device according to FIGS. 1 and 2, wherein the actuating means is reproduced extended, i.e.

The locked state of the presenting device 1 is shown in FIG. 2.

Figure 3:
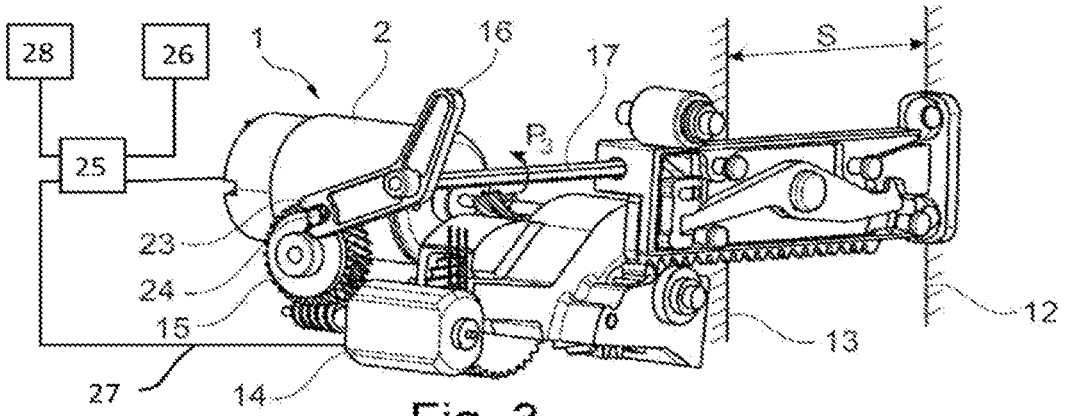
FIG. 3 shows the position of the actuating means in a presenting position of the motor vehicle door element, wherein the motor vehicle door element is held in the presenting position by means of the locking means.

FIG. 3 shows the presenting device 1 in a presenting position of the motor vehicle door element 13. The actuating means 6 has been moved completely out of the motor vehicle door element 13 by means of the drive 2, a displacement S being drawn in FIG. 3. The locking lever 8 is still in engagement with the locking contour 10, so that the motor vehicle door element 13 is held securely in the presenting position. If the motor vehicle door element 13 is now gripped, for example by the operator of the motor vehicle, an extension 20 of the transmission carrier 21 pivots in the direction of the arrow P2 in FIG. 2. The movement of the extension 20 of the transmission carrier 21 can be detected by means of the sensor 22, whereby a control signal can be transmitted to the locking drive 14 by means of the control system.

A control signal for the locking drive 14 causes the locking drive 14 to pivot the operating lever 16 via the gear 15. In this embodiment, the operating lever 16 and the gear unit 15 are operatively connected by means of a recess 23 and a cylindrical pin 24 arranged on a gearwheel of the gear unit 15. Pivoting the operating lever 16 causes the actuating shaft 17 to be rotated in the direction of the arrow P3, causing the sliding element 18 to pivot the locking lever 8 about the axis 9, thereby disengaging the locking lever 8 from the locking contour 10. The motor vehicle door element 13 can be opened manually and the actuating means 6 is returned into the motor vehicle door element 13.

If it now happens, for example, in the position of the motor vehicle door element 13 as reproduced in FIG. 3, that no sufficient power supply is available for the locking drive 14, the operating lever 16 can be gripped, for example through an opening in a door panel, and the locking lever 6 is released from engagement with the locking contour 10. It is of course also conceivable that the operating lever 16 is connected to, for example, a Bowden cable, so that the operating lever 16 can be operated remotely.

FIG. 3 further shows a control unit 25 which, on the one hand, is electrically connected to the presenting device 1 and, on the other hand, to a further sensor 26. The control unit 25 is connected by means of a connecting line 27 to the electric drives 2, 14 of the presenting device 1 and further, by way of example, to an interior door handle 28. In this context, the control unit 25 may be a control unit 25 of the motor vehicle or may also be a door-internal control unit 25 which, for example, is associated with the presenting device 1 and/or a lock or represents a part of the presenting device 1 itself. By means of the control unit 25, it is possible to combine the functions of the further sensors 26 and the interior door handle 28, but also a control signal from an operator of the motor vehicle. In this combination it is thus possible, on the one hand, to initiate a usual presenting or, on the other hand, to represent further functions by means of the further sensors.

If, for example, the inner door handle 28 is now actuated, while at the same time a child safety lock has been switched on by the operator of the motor vehicle with respect to the inner door handle 28, the presenting device 1 can prevent the opening process. To stop the opening, the locking lever 8 can be engaged with the contour 10, whereby a braking effect can be introduced into the door element 13 by means of the electric drive 2. In this case, the presenting device 1 serves as a child safety device.

Even in the case of manual opening, movement of the door element 13 can be prevented by means of the presenting device 1, for example in order to represent an anti-theft device. It is advantageous in the representation of these extended functions of the presenting device 1 that no additional components are required in the door element and/or in the lock.

REFERENCE LIST

1 Presenting device
2 Electric drive unit
3, 15 Gear unit
4 Gear wheel
5 Rack
6 Actuating means
7 Inside of the actuating means
8 Locking lever
9 Axis
10 Locking contour
11 Hook-shaped end
12 Vehicle body
13 Motor vehicle door element
14 Locking drive
16 Operating lever
17 Actuating shaft
18 Sliding element
19 Guide means
20 Extension
21 Transmission carrier
22 Sensor
23 Recess
24 Cylinder pin
25 Control
26 Motion sensor, environment sensor
27 Connecting line
28 Inner door handle
P1, P2, P3 Arrow
S Displacement

The invention claimed is:

1. A presenting device for a motor vehicle door element comprising:

an electric drive unit and an actuating means, wherein the actuating means is adjusted by means of the drive unit, a transmission arranged between the actuating means and the electric drive unit, so that a movement of the door element moves the door element with respect to a motor vehicle body, and a locking means, wherein by use of the locking means the door element is maintained in position and the locking means is electrically actuated, wherein the locking means is indirectly actuated, wherein the locking means has a locking lever pivotable between a locked position to connect the door element and the motor vehicle body and an unlocked position to disconnect the door element and the motor vehicle body, and wherein the locking lever in the locked position maintains the connection between the door element and the motor vehicle body during the movement of the door element.

2. The presenting device according to claim 1, wherein the locking lever is manually pivotable.

3. The presenting device according to claim 2, wherein the locking lever is pivoted electrically by means of a locking drive.

4. The presenting device according to claim 2, wherein the locking lever can be actuated indirectly by means of an actuating shaft.

5. The presenting device according to claim 4, wherein an operating lever is provided and in that the operating lever is operatively connected to the actuating shaft.

6. The presenting device according to claim 5, wherein the operating lever can be actuated electrically.

7. The presenting device according to claim 5, wherein the operating lever and the locking drive are operatively connected by means of a gear unit.

8. The presenting device according to claim 5, wherein the actuating shaft is accommodated displaceably in the actuating means.

9. The presenting device according to claim 5, wherein the operating lever is manually pivotable, wherein manual pivoting of the operating lever causes pivoting of the locking lever between the locked position and the unlocked position.

10. The presenting device according to claim 1, wherein an actuating means is in engagement with the actuating shaft.

11. The presenting device according to claim 10, wherein the actuating means is a sliding element.

12. The presenting device according to claim 11, wherein the sliding element is guided in a linearly displaceable manner in the actuating means.

13. The presenting device according to claim 12, wherein linear displacement of the sliding member causes the locking lever to pivot about an axis in the actuating means.

14. The presenting device according to claim 1, wherein the presenting device can be controlled by means of a control unit.

15. The presenting device according to claim 1, wherein an actuation of an inner door handle can be detected by means of the control unit, wherein a signal of the actuation of the inner door handle can be evaluated for controlling the presenting device.

16. The presenting device according to claim 1, wherein a movement of the door element can be detected by means of a movement and/or environment sensor, wherein a signal of the movement and/or environment sensor can be evaluated for controlling the presenting device.

17. The presenting device according to claim 1, wherein at least one further electric drive is provided for moving the door element.

18. The presenting device according to claim 1, further comprising a locking contour engaged by a hook end of the locking lever in the locked position, wherein the hook end is spaced from the locking contour in the unlocked position, wherein the locking contour is attached to the motor vehicle body, wherein the locking lever is attached to the door element.

* * * * *